United States Patent [19]

Bounds

[11] 4,275,538

[45] Jun. 30, 1981

[54] BUILDING FOUNDATION METHOD AND SYSTEM, WITH ENERGY CONSERVATION AND SOLAR ENERGY UTILIZATION FEATURES

[76] Inventor: Edward G. Bounds, 1209 Frederick Ave., Salisbury, Md. 21801

[21] Appl. No.: 114,355

[22] Filed: Jan. 22, 1980

[51] Int. Cl.[3] ..... E02D 24/42

[52] U.S. Cl. ..... 52/299; 52/294; 52/122; 52/169.9; 52/742; 165/48 S; 126/430

[58] Field of Search ..... 52/299, 294, 742, 169.9, 52/744, 292, 296, 122, 309.12; 165/48 S; 126/428, 429, 430; 405/229

[56] References Cited

U.S. PATENT DOCUMENTS

| | | | |
|---|---|---|---|
| 2,298,184 | 10/1942 | Rosenberg . | |
| 2,372,200 | 3/1945 | Hayes . | |
| 2,462,415 | 2/1949 | Nagel . | |
| 2,903,877 | 9/1959 | Meade | 52/744 X |
| 3,135,097 | 6/1964 | Scheinberg . | |
| 3,194,853 | 7/1965 | Weise et al. . | |
| 3,216,163 | 11/1965 | Carew | 52/299 X |
| 3,292,329 | 12/1966 | Garancsy . | |
| 3,653,168 | 4/1972 | Cook | 52/294 |
| 3,848,377 | 11/1974 | Mori | 52/169 |
| 3,958,954 | 5/1976 | Ehlenbeck | 52/583 X |
| 4,062,347 | 12/1977 | Jensen | 126/430 |
| 4,084,362 | 4/1978 | Piazza | 52/309.12 X |
| 4,107,889 | 8/1978 | Gonsalves et al. | 52/259 |
| 4,124,963 | 11/1978 | Higuchi | 52/742 |
| 4,192,291 | 3/1980 | Arent | 126/428 X |

OTHER PUBLICATIONS

"Retrofitting is for Your House Now", Oshin *Remodeling,* Fall 1977, pp. 118–120.

"Passive Solar Update", Morgan, *Building,* Fall, 1978, pp. 99+.

"Passive Solar", Perron, *Building,* Summer 1979, pp. 98–99, 111.

*Primary Examiner*—Carl D. Friedman

*Attorney, Agent, or Firm*—Bacon & Thomas

[57] ABSTRACT

A plurality of footing pits are dug, and a preformed footing is placed in each. Each footing has a recess in its bottom covered by a sheet of flexible material, a grout inlet opening leading to the recess, and a plurality of relief ports. Grout is injected into the recess of each footing to seat it in its pit, and then a base plate support is installed thereon and adjusted to a selected height. Preformed beams are then mounted on the base plate supports, to provide a foundation for a building. Energy conservation is achieved by placing an insulating element vertically in each preformed beam, and solar energy collector equipment is mounted on the face of at least one beam. The solar energy collector equipment takes advantage of the location of the beams and their construction from precast concrete, and is of both the passive and active type.

43 Claims, 16 Drawing Figures

FIG. 1

BUILDING FOUNDATION METHOD AND SYSTEM, WITH ENERGY CONSERVATION AND SOLAR ENERGY UTILIZATION FEATURES

TECHNICAL FIELD OF THE INVENTION

This invention relates generally to a new method and system for constructing a building foundation. More particularly, it relates to a method and system for constructing a building foundation utilizing preformed beams and footings that significantly reduces cost and the time required for construction as compared to conventional foundations, and which includes provisions for energy conservation and the utilization of solar energy.

BACKGROUND OF THE INVENTION

It has long been recognized that houses, utility buildings and other structures should be erected upon a foundation rather than simply being placed directly on the earth. In times past such foundations were often erected using cut or rough stone, rubble and the like. For a number of reasons, this type of construction has been largely replaced over the years by foundations made of poured concrete footings with a wall of hollow concrete blocks set in place thereon, and this kind of foundation is now standard in the building industry.

Typically, such foundations are constructed by first laying out the perimeter of the foundation wall with batter boards, grade stakes, nails and string. Then a crawl space area is excavated, and continuous footing trenches are dug, leveled and tamped. Reinforcing rods or elements are then placed in the trenches, and concrete is poured and allowed to set to form a footing for receiving the hollow concrete blocks.

The concrete blocks are then set by hand upon the poured footings, one at a time, using cement mortar as the leveling and bonding medium. Finally, the building is installed on the wall of concrete blocks and is secured thereto by any one of several methods. This process for foundation construction is obviously labor intensive and calls for a number of different skills by the workmen. It is also subject to a number of construction errors, such as can occur when foreign materials like pieces of wood are utilized to initially support the reinforcing elements, and are then not removed before pouring the concrete.

There are in fact a number of disadvantages with this kind of foundation construction, including the following:

1. Structural quality of the poured continuous footing is difficult to control on the job site because of failure to properly install reinforcement elements, earthen footing trench walls caving in before or during the placement of the concrete, and weather conditions such as heavy rains occurring before the concrete has been poured and sets. These conditions usually result in later differential settlement of the footings at points where their structural integrity is impaired, which can cause resultant damage to the concrete block wall and to the building structure resting on the footings. In the case of the block walls, the resulting damage can be in the form of continuous cracks in the mortar joints, or even ultimate block failure if the weight of the building is shifted and becomes improperly applied. The building itself can be damaged to a lesser or greater extent, ranging from wall cracks and nonaligned doors and windows, to collapse of the whole building.

2. The hollow concrete blocks normally used are porous and, unless properly sealed and painted, they will continually entrap moisture which can then cause structural damage, especially during periods of alternate freezing and thawing. The block walls also normally provide a damp crawl space area and offer no effective insulation against the passage of heat.

3. Because of the complexity of the construction, poured in place footing and hollow concrete block foundations require careful coordination between a number of different workmen skills, which skills may or may not always be available and, the practice of which, in all cases requires many hours of increasingly expensive labor.

4. The construction of poured in place footing and hollow concrete block foundations is especially dependent upon relatively lengthy periods of good weather, because of the time required for construction and the use of earthen trenches for the footings.

5. The hollow concrete block walls placed on the footings are not an especially aesthetically pleasing form of construction, and present an unfinished look unless further labor intensive and expensive steps are taken to dress them up.

All of these disadvantages are heightened when working with the modular or prefabricated buildings of today, which arrive at the job site ready to be installed in functioning condition. The transport of these manufactured buildings is expensive and must be properly scheduled to achieve economically satisfactory results, but this scheduling is difficult to achieve in many instances because of the unanticipated delays often involved with the normal poured footing and concrete block type of foundations.

The need for better foundation construction methods has been recognized, and there have been attempts at providing improved foundations. One such effort is represented by U.S. Pat. No. 4,107,889, wherein precast concrete beams are installed upon poured-in-place piers utilizing hollow pedestals, reinforcement elements, and poured concrete for the actual installation. However, again the basic problems with pouring concrete into earthen forms is present, and the workmen skills required for construction are still extensive and the process lengthy.

There is thus need for an improved method and system for foundation construction designed to reduce to a minimum the type and amount of skilled labor needed at the job site, and which will produce significantly superior foundations of uniformly high quality at a lower cost than is possible today. The present invention is intended to satisfy that need.

There is also a greater need today than ever before to include energy conservation measures in building construction, a matter which has been essentially totally ignored over the years in foundation construction, in part because the conventional poured footing and concrete block foundation does not lend itself to energy conservation measures. The present invention is also intended to address the need for energy conservation in foundations, and at the same time provides unique opportunities for taking advantage of the sun as an energy source.

BRIEF SUMMARY OF THE INVENTION

The foundation method and system of the present invention makes use of preformed beams instead of hollow concrete block walls to provide a supporting base for a building structure, the preformed beams preferably being made of precast concrete produced under controlled factory conditions for assured quality.

The preformed beams are utilized in conjunction with footing members that are also preformed, each comprising a normally rectangular slab of precast concrete provided with a recess in its bottom surface, and having an internally threaded anchor embedded centrally of its upper surface. A grout inlet opening extends vertically through the footing member, and the member also has an array of smaller in diameter relief ports spaced from the grout inlet opening and extending vertically through the slab from the recessed bottom area thereof. A sheet of flexible material is placed over the recess in the bottom surface of the footing, the sheet forming a diaphragm which together with the walls of the recess defines a protected cavity for receiving grout under pressure.

The precast footings are installed in a manner that will be described, and are utilized to support the preformed beams through base plate means mounted on each footing. Each base plate means includes a threaded shaft receivable in its associated internally threaded anchor, and which carries a base plate on its upper end. The shafts of the several precast footings are turned to place their base plates at the correct elevation, and the preformed beams are then placed on the base plates. In the preferred embodiment of the invention the preformed, precast concrete beams have metal anchor plates embedded therein at support locations, and the beams are secured by welding these anchor plates to each other and to the base plates.

The foundation system elements of the invention are installed according to the unique method of the invention, which begins with the excavation of any desired crawl space at the building site. Then, simple footing pits are excavated at the building site, one at each location where it is desired to provide support for the preformed beams.

The precast footings are then placed in the footing pits, with the sheet of flexible material placed over the bottom surface thereof and extending up the footing sidewalls. The area between the footing sidewalls and the sidewalls of the pit is then initially backfilled and tamped, in effect sealing off the footing's cavity. A source of pressurized grout is then connected to the grout inlet opening of each footing, and grout is pumped or injected under pressure into the cavity therebeneath. The diaphragm formed by the flxible sheet protects the cavity during the initial stages of footing installation, and then flexes as the cavity fills with grout. The grout will push the flexible sheet outwardly to conform with the pit walls, and will fill all of the space between the precast footing and the bottom of the pit.

The array of smaller diameter relief holes in the precast footing is utilized to relieve air from the cavity and to ensure that proper placement of the grout is occurring. As the cavity beneath a precast footing fills with grout, grout will become visible at a first one of the relief holes at the top of the footing, whereupon that hole is closed with a simple plug. This process continues until all of the relief holes have been plugged. Then, more grout is pumped or injected until a preselected grout pressure is attained which is just below the point where significant elevation of the footing would occur. Pumping of the grout is then terminated, and the source of grout is disconnected from the inlet opening. The inlet opening is then closed to prevent the escape of the grout until such has preliminarily set, which can be done by placing a wooden plug therein or, preferably, by utilizing a simple flap valve element secured to the bottom wall of the precast footing's recess.

After the precast footings have been installed, the threaded shafts are mounted in their respective anchors, and the base plates are all brought to the desired level. The preformed beams are then installed on the base plates, and the area between the base plates and the top surface of the precast footings will normally be filled with grout. Then any final backfilling is done, and the foundation is complete.

The method and system of the invention offer many advantages, not the least of which is that the whole construction process can be quickly done with a minimum number of workers. It has been found that in a typical construction situation cost savings in the range of 50% are possible with the present invention over conventional poured footing and concrete block foundations of a similar size. More importantly, the work done at the construction site is minimal, is less prone to quality control problems than present foundation approaches, and is not significantly affected by weather conditions. In colder weather, heated grout can be employed, and the grout can even be safely placed during a rainfall. Further, the earthen pit is not critical as to shape, and wide latitude is given the workers.

There are a number of additional benefits that flow from the present invention, including the following:

1. Structural integrity of the resultant foundation is more easily assured than in conventional foundations, because the precast footings and the preformed beams can be manufactured under factory controlled conditions and later transferred to the work site.

2. The preformed beams can be manufactured with vents, doors, piping and the like formed therein.

3. The use of the spaced precast footings and the elevated beams makes it easy to install utility pipes and conduits prior to backfilling by simply laying such under the elevated beams.

4. The aesthetic appearance of the preformed, precast concrete beams is superior to the appearance of concrete block foundation walls. Beyond this, the exposed surface of the beams can be shaped during molding in the factory to resemble brick, stone, or some other formation.

5. The use of the preformed, precast concrete beams offers significant opportunities to conserve energy, and a new concept for utilizing solar energy.

The last-listed benefit is of great importance. In the present invention, significant energy savings in heated buildings can be obtained by placing an insulating element, such as a polystyrene block, vertically within the beam during casting thereof. This can be accomplished without impairing the structural integrity of the beam, if the beam is properly engineered. The result of including the insulating element can be to greatly reduce heat transfer through the foundation, which tends to insulate the crawl space beneath the building with a significant accompanying improvement in the energy efficiency of the structure. The problem of dampness normally associated with concrete block foundation walls can also be alleviated in this manner.

Beyond energy conservation, the precast concrete beams of the invention are also employed to carry solar energy collector elements. In the past, such elements have usually been placed on the roof of a structure, or elsewhere on the building. It has been discovered that collector elements can be incorporated in a precast foundation beam or mounted thereon after installation, and that they can function effectively.

It is known that the vertical wall of a brick or stone building exposed to the sun can retain heat, and thus acts as a heat sink. It has been proposed that such walls can be used for solar heating by mounting collector panels thereon and providing for air flow between the wall and the panels. The present invention makes use of this concept to provide a solar energy system for a conventional wood or metal-walled building.

More specifically, the present invention contemplates utilizing the preformed beams to carry solar collectors as part of both passive and active solar energy systems, designed in a unique manner to provide heat and energy to the building mounted on the foundation. The beams constitute the heat sink for the system. It has been found that the reduced costs for foundation construction resulting from utilizing the present method and system can relieve all or a major part of the cost of the solar equipment contemplated in the invention, which thus can make it possible for an owner to acquire at least a basic solar energy system at substantially no increase in cost over conventional construction.

It is a principal object of the present invention to provide an improved method and system for constructing foundations, designed to greatly reduce construction costs over normal techniques and to require a minimum number of skilled workmen for installation.

Another object is to provide a foundation system which includes significant energy saving features, and which can be combined with solar energy equipment to provide an efficient and relatively inexpensive solar heating and energy system.

A further object is to provide a foundation method and system which allow critical elements thereof to be manufactured under factory conditions to assure uniform high quality.

Still another object is to provide a method and system for constructing foundations that are especially compatible for use in erecting manufactured buildings, by allowing for a short and predictable length of construction time.

It is also an object to provide an arrangement for supporting preformed foundation beams, designed for easy adjustment vertically and to a horizontal plane.

Other objects and many of the attendant advantages of the present invention will become readily apparent from the following description of the preferred embodiments, when taken in conjunction with the accompanying drawings.

DETAILED DESCRIPTION OF THE PREFERRED EMBODIMENTS

Referring now to FIGS. 1-5 of the drawings, a foundation constructed according to the present invention is indicated generally at 2, and is constructed within a crawl space excavation 4 made in the earth E at the building site. While a crawl space excavation may not be employed in all cases, the use thereof is common. Typically, a crawl space excavation will be about 8' longer and wider than the building which is to be erected, and will have a shallow depth of from 12" to 20".

The foundation 2 of the invention can be utilized to support many different kinds of buildings. While it has special utility for use with residential dwellings of the modular type which are manufactured in a factory and transferred to the job site, it is also usable for prefabricated machine sheds, chicken houses, utility buildings and, indeed, essentially any kind of structure. It is also adaptable for use to support either single or multi-floor dwellings, apartment houses, and similar structures.

Figure 1:
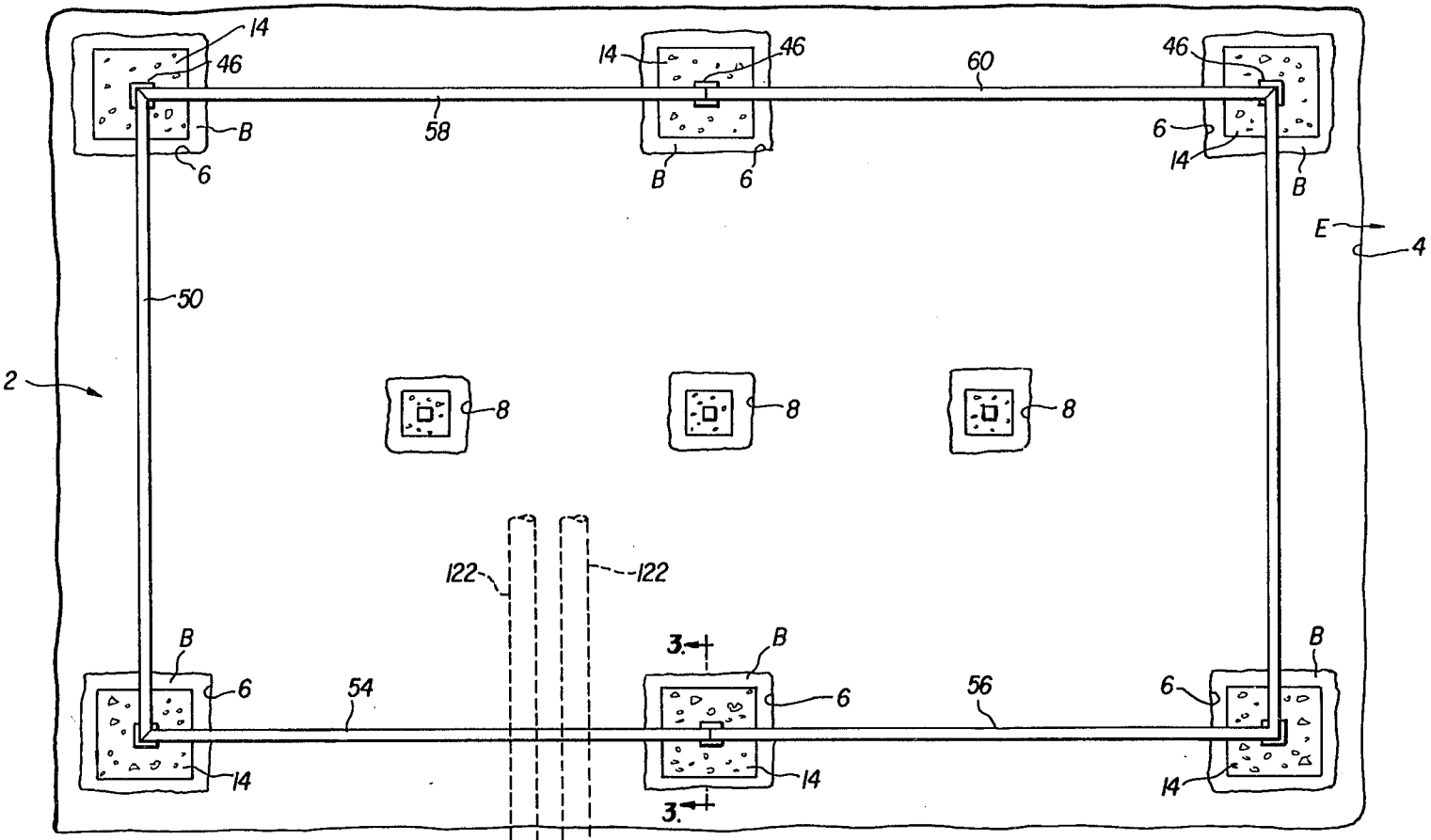
FIG. 1 is a top, plan view of a building site having an excavated crawl space, and shows a building foundation comprising a set of footings and preformed beams constructed in accordance with the invention.
Figure 2:
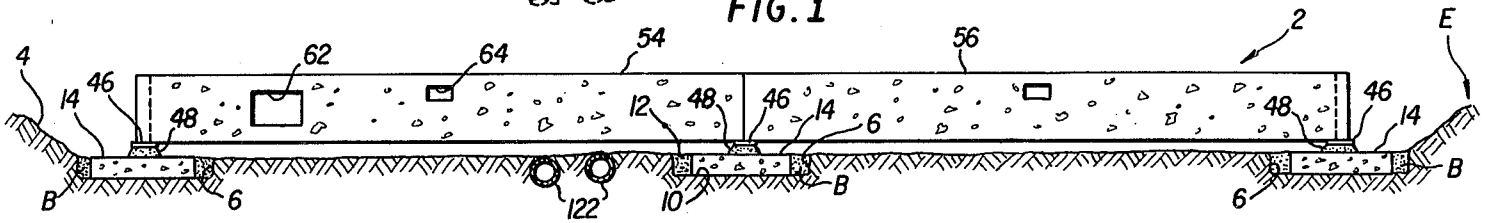
FIG. 2 is a front elevational view of the building foundation of FIG. 1.

The size of the crawl space excavation 4 and the configuration and size of the foundation 2 will of course be dependent upon the nature of the building structure to be erected thereon. However, the principles of the method and system of the invention remain the same regardless of the type of building to be supported. In FIG. 1 it is assumed that the structure to be supported will be a residential home of the manufactured type, measuring perhaps 28′ by 48′, and incorporating a floor girder which must be supported.

Given the details of the building to be erected, the crawl space excavation 4 is made. Shallow footing pits 6 are then dug where required along the perimeter of the foundation, and similar pits 8 are dug where supporting piers for the floor girder are needed. Each of the footing pits 6 has a bottom wall 10 and sidewalls 12, and is dug with dimensions that will exceed the precast footing to be placed therein. However, only a minimum of care need be taken in preparing the pits, since the method and system of the invention are intentionally designed to accommodate variations in the depth and in the wall smoothness and continuity of the pits.

Figure 4:
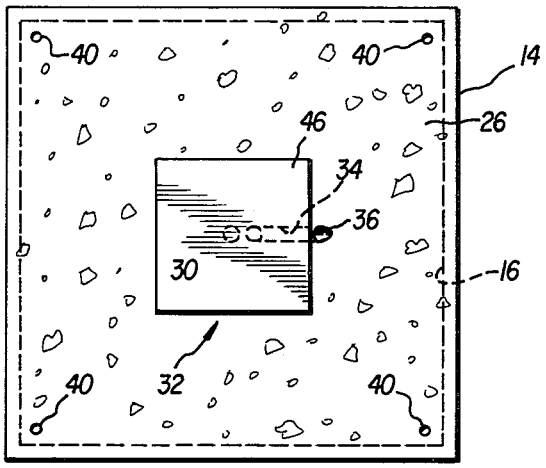
FIG. 4 is a top plan view of a precast footing assembly constructed according to the invention.
Figure 5:
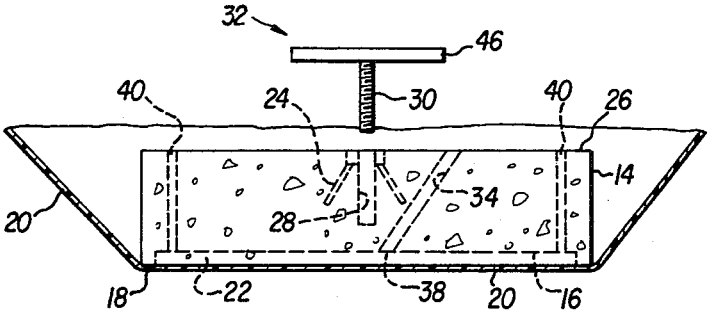
FIG. 5 is an exploded, front elevational view of the footing assembly of FIG. 4 with the flexible sheet shown in section.
Figure 3:
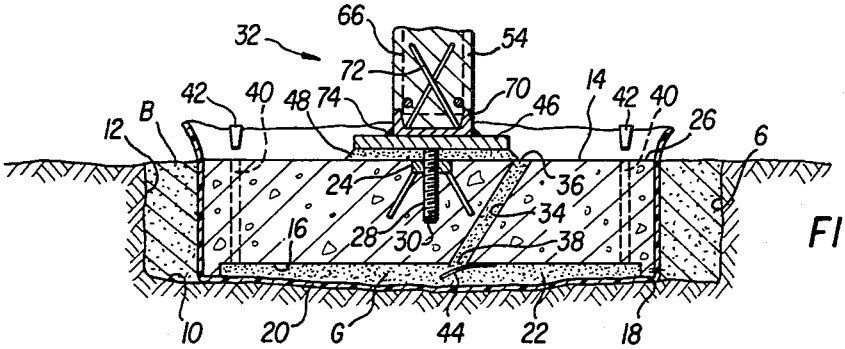
FIG. 3 is an enlarged, sectional view taken generally on the line 3—3 of FIG. 1, and shows in detail the construction of one of the precast footing installations.

Once the pits 6 and 8 have been prepared, a precast footing 14 is placed into each of the footing pits 6. As best shown in FIGS. 3–5, each precast footing 14 is preferably rectangular in shape, although other shapes can be adopted. The bottom surface of the footing 14 has a shallow recess 16 therein, surrounded by a perimeter face 18. A sheet of flexible material 20 is placed over the bottom of the footing and defines a diaphragm which, together with the recess 16, defines a protected cavity 22 into which pressurized grout can be pumped or injected.

The sheet of flexible material 20 can be made of polyethylene or another suitable material having the characteristic that it will give as grout is pumped into the cavity 22 and will conform to the contours of the bottom of its associated pit 6. The diaphragm formed by the sheet 20 serves to protect the cavity 22 and the lower end of the grout inlet opening 34 during placement of the footing 14 in its pit, to assure a subsequent even flow and distribution of the pressurized grout.

The sheet forming the diaphragm can have the same dimensions as the footing 14 and can be secured in the factory to the perimeter face 18 of the recess 16 with an adhesive, if so desired. This has the advantages of conserving material and of being produced under controlled conditions. However, the resultant diaphragm is easily damaged in transit to the job site. Alternatively, a footing-sized sheet can be similarly attached to the perimeter face 18 at the job site. The preferred practice, however, is to use a large sheet of material 20, as shown in FIGS. 3 and 4, which is simply placed under the footing 14 as it is lowered into the pit 6, the outer portions of the sheet being pulled up against the sidewalls of the footing after the footing is in place, and the area between the footing and the sidewalls 12 of the pit then being initially backfilled.

Each of the precast footings 14 is made with an internally threaded anchor assembly 24 mounted centrally of its top surface 26, the footing being provided with a recess 28 beneath the anchor assembly 24 of sufficient depth to accommodate the lower end of the threaded shaft 30 of a base plate assembly 32. A grout inlet opening 34 extends vertically through the footing 14, but is inclined at an angle so that while the upper end 36 thereof is offset a sufficient distance from the anchor assembly 24 to allow for proper functioning of the base plate assembly 32, the lower end 38 of the opening is disposed centrally of the cavity 22.

Spaced from the inlet opening 34, and preferably located at spaced intervals along the outer periphery of the recess 16, are a number of relief ports 40. The relief ports 40 also extend vertically through the precast footing 14 and, as shown in the drawings, a convenient arrangement is to place one at each corner of a rectangular recess 16. The relief ports 40 have a substantially smaller diameter than the inlet opening 34, related to the flow characteristics of the grout. The grout should flow relatively freely through the inlet opening 34, but should flow through the relief ports 40 only under pressure. The opening 34 and the relief ports 40 are sized to accommodate the grout being used, and to assure proper carrying out of the method of the invention.

Once a precast footing 14 has been placed in its footing pit 6 with the sheet of material 20 therebeneath, the edges of the sheet are pulled upwardly and inwardly to lie against the sidewalls of the footing. Then, backfill B is placed in the pit 6 between the footing and the pit sidewalls 12 and is tamped down. The backfill B is placed completely around the footing 14, and serves to seal the area around the footing against the flow of grout. The discharge hose (now shown) of a conventional machine capable of producing grout under a pressure sufficiently high in value to assure the carrying out of the invention is then connected to the upper end 36 of the grout inlet opening 34, and thereafter grout G is pumped or injected under pressure into the cavity 22.

The step of pumping or injecting grout into the cavity 22 of each footing 14 is continued until all of the space between the footing and the bottom of the associated pit 6 is filled with the grout G, and the footing 14 is firmly seated. The relief ports 40 assist in making the determination as to when this finished state is reached. As pumping of the grout G occurs, air pressure within the cavity 22 is first relieved through the ports 40 and then, at a certain point, grout G will appear at the upper end of one of the relief ports. That relief port is plugged with a wood or other suitable plug 42 (FIG. 3), and pumping or injection of the grout is continued. This continues until all of the relief ports 40 have bled grout. Then, additional grout G is pumped or injected into the cavity 22 until a preselected grout pressure is achieved, a pressure just slightly less than that required to vertically lift the mass of the footing a significant distance. The selected pressure will be related to the size and weight of the footing 14, and is calculated by known methods. Once grout has bled from all of the relax ports 40 and the preselected pressure has been achieved, proper seating of the footing is assured.

The discharge hose from the grout machine is then disconnected and the grout inlet opening 34 is closed to assure that the grout G remains in position until it preliminarily sets and finally cures. The opening 34 can also be closed by a plug, but preferably a simple flap valve is utilized at the lower end thereof. Referring to FIG. 3, a flap valve 44 of rubber or the like is hinged to the bottom wall of the recess 16, and closes under pressure from the grout G in the cavity 22 when pumping or injection is terminated.

Because the footings 14 are precast in a factory, the quality thereof can be tightly controlled. At the building site, no particular skills are required by the workmen who install the footings 14. The pits 6 need not be dug with precision and pumping or injection of the grout G beneath each footing 14 can be quickly done. The flowing grout accommodates itself to the configuration of the pit and provides assured, firm seating for the footing.

The actual dimensions for a footing 14 will depend to a great extent upon the weight of the building to be borne thereby, local soil bearing capacities, other loading factors like snow and wind, and the like. A typical size would be about 3′ square by about 10″ in height, with the recess 16 being about 1" deep, the grout inlet opening 34 having a diameter of about 1", and the relief ports 40 being about ⅜" in diameter. The grout mixture utilized can be varied, but must have the necessary load-bearing capacity.

Once all of the footings 14 are in place, the base plate assemblies 32 are installed thereon. As is shown in the drawings, each assembly 32 includes a threaded shaft 30, to the upper end of which a base plate 46 is secured. The shafts 30 are inserted into their respective internally threaded anchor assemblies 24, and are turned until all of the base plates 46 are at the proper, preselected elevation. It will sometimes occur that the footings 14 will not be installed so that they are level and, indeed, this can be expected to occur with some frequency. To compensate for this, the base plates 46 are simply bent about the vertical axes of their respective threaded shafts 30 until the top surfaces thereof have the desired planar orientation. The base plates 46 are mounted centrally thereof to their shafts, so that they will remain properly centered even when tilted to achieve proper planar orientation.

It is also possible to level the top surfaces of the base plates 46 by bending the threaded shafts 30, which may be necessary if the footings 14 are tilted sharply. It will be understood that leveling and planar orientation of the base plates 46 can be easily achieved at the job site using a conventional builder's level or transit, with a minimum of workmen required.

Once the base plates 46 are properly positioned, they can be secured as to elevation by placing a tack weld between their shaft 30 and the exposed upper end of the anchor assembly 24. Alternatively, a conventional lock nut carried on the shaft 30 can be used. Then, the space beneath the base plate 46 will normally be filled with grout 48 to complete the installation. It is often desirable to coat the metallic components with asphalt or the like, especially in areas where ground wetness is prevalent.

The next step of the method is to install preformed beams on the base plates 46, these beams completing the foundation. Referring again to FIG. 1, there are shown two end beams 50 and 52, two front side beams 54 and 56, and two rear side beams 58 and 60, the ends of all the beams coming to rest on one of the base plates 46.

In the preferred embodiment of the invention, the preformed beams are all made of reinforced, precast concrete, although it is to be understood that beams of wood or steel might also be employed, for example. However, precast concrete offers a number of significant advantages.

First of all, precast concrete beams can be made in a factory at relatively low cost and yet with a high degree of quality control Further, it is an easy matter to cast window openings and access openings into the beams, such as are shown at 62 and 64, respectively, in the preformed beam 54. Finally, forming the beams of concrete makes possible many different surface configurations, simply by placing the desired surface configuration into the casting mold. For example, the exposed beam surfaces can be made to look like brick or stone, or they can be given either a rough, a textured, or a smooth surface.

Figure 6:
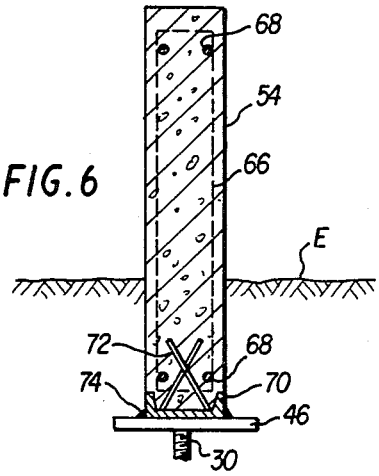
FIG. 6 is a vertical sectional view through a typical preformed beam showing the construction thereof.

The construction of the preformed, cast concrete beam 54 is shown in cross section in FIGS. 3 and 6, FIG. 6 representing the beam after final backfilling has occurred. The beam incorporates wire mesh reinforcing 66 and reinforcing rods 68, arranged in a pattern to provide structural integrity and strength to the beam. The lower face of the preformed beam 54 incorporates a U-shaped channel iron 70 supported by braces 72, which forms an anchor plate to secure the beam to its base plate 46. Once the beam 54 has been properly positioned on its base plate 46, it is secured thereto by welds 74.

In addition to welding the preformed beams to their base plates 46, in the preferred embodiment of the invention, the structural integrity of the foundation is increased by welding the beams to each other. This is accomplished by the use of further anchor plates, as shown in FIGS. 8 and 9.

Figure 8:
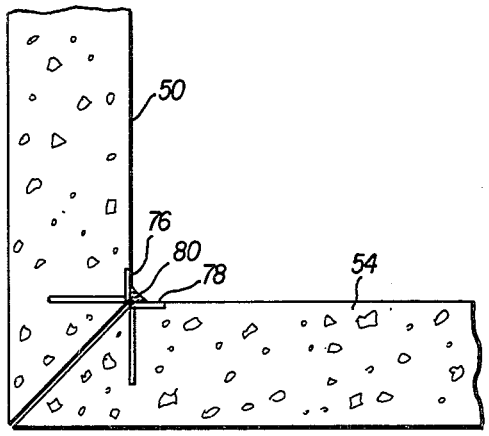
FIG. 8 is an enlarged, fragmentary top plan view showing the connection arrangement at a corner junction of two preformed beams.
Figure 9:
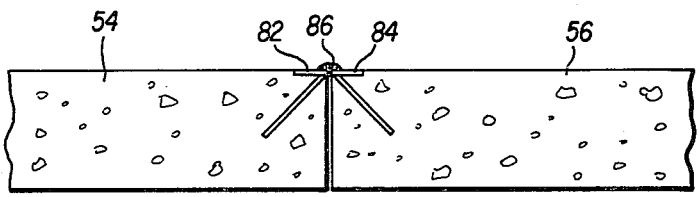
FIG. 9 is an enlarged, fragmentary top plan view showing the connection arrangement between two aligned preformed beams.

In FIG. 8, the abutting corner-forming portions of the beams 50 and 54 are shown in an enlarged plan view, and it is seen that the internal, mating vertical edges of the beams respectively have metallic anchor plates 76 and 78 cast therein, which are secured together by a weld 80. Similarly, FIG. 9 shows the abutting faces of the beams 54 and 56, and it is again seen that the internal, mating vertical edges thereof carry anchor plates 82 and 84, respectively, secured together by a weld 86. The welded connections are easy to make in the field, and provide a foundation that is rigid and strong.

Figure 10:
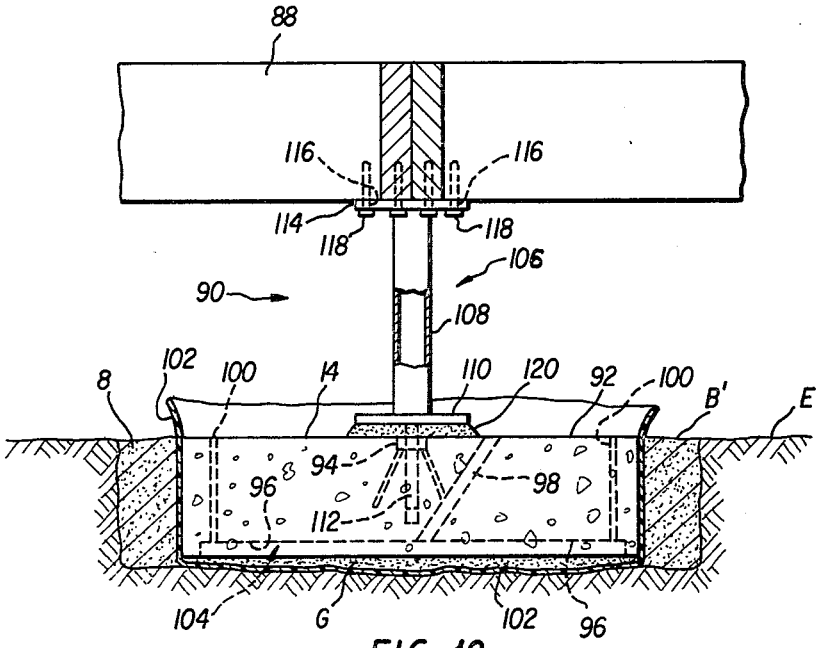
FIG. 10 is an enlarged, vertical elevational view, partly in section, showing one of the central pier assemblies for supporting the floor girder of a building erected on the foundation.

Turning now to FIG. 10, one of the supporting piers for the floor girder 88 of a building placed on the foundation 2 is shown at 90. The piers 90 are located where necessary within the foundation 2, and the pits 8 are dug therefor. Then, a precast footing 92 is placed in each pit 8, the footings 92 being identical to the footings 14 in construction, but usually substantially smaller in area. Each footing 92 has an anchor assembly 94 therein and includes a recess 96 in its bottom, an inclined grout inlet opening 98, and relief ports 100. The recess is covered by a flexible sheet of material 102 to define a cavity 104, the pit 8 receives initial backfill B', and grout G is pumped or injected into the cavity.

Mounted upon each footing 92 is a supporting base structure 106 that differs from that employed with the footing 14. The supporting base 106 includes a tubular standard 108 welded to a base plate 110, from which is threaded shaft 112 extends downwardly, the shaft 112 being receivable in the anchor assembly 94. The upper end of the standard 108 carries a mounting plate 114 provided with a plurality of openings 116 therein.

After the footing 92 has been installed, the supporting base 106 is mounted thereon, the shaft 112 being turned until the mounting plate 114 is at the desired elevation, and the planar orientation of the mounting plate 114 being adjusted by bending the base plate 110 on its shaft 112, and if necessary by bending the shaft itself. Then, after the floor girder 88 has been placed on the mounting plates 114, it is secured thereto by lag screws 118 passed through the openings 116. The space between the base plate 110 and the top of the associated footing 92 is usually filled with grout 120.

From the foregoing, it is seen that the method and system of the invention provide a foundation which can be easily constructed using elements that are made in a factory where quality control can be assured. The foundation can be quickly erected at the building site, and construction can occur in essentially any weather. This makes the invention especially adapted for use with manufactured buildings, in that assurance is present that a foundation for the building can be prepared at the building site by a selected arrival time. Further, the number of workmen required to construct the foundation of the invention is minimal, and the skills necessary are less than are usually required for foundation work.

To recapitulate the method of the invention, the site is first prepared by making any desired crawl space excavation, and then a plurality of spaced footing pits are excavated. The next step of the method is to place a preformed footing into each of the footing pits, with a flexible sheet 20 in place thereunder, followed by initially backfilling the pit around the perimeter of the footing. A source of pressurized grout is then connected to each footing, and grout is pumped into the cavity on the undersurface of the footing until all of the space between the footing and the bottom of the associated footing pit is filled, and the footing is firmly seated. Then, the source of the grout is disconnected, the grout inlet opening is plugged, and the grout is allowed to set.

A base plate means is then installed on each footing, the top surfaces of all the base plate means being leveled to a predetermined relationship. The space between the base plate means and the top of the footing is then filled with grout, and thereafter the preformed beams are placed on the base plate means and secured. The foundation thus constructed then receives any final backfilling.

A feature of the invention is the ease with which utility and other underground installations to serve the building can be placed. Referring again to FIGS. 1 and 2, utility conduits are illustrated at 122, and such are simply placed under the elevated preformed beams of the foundation. This is preferably done before final backfilling occurs, which means that in some installations the conduits 122 can even be laid directly on the bottom of the crawl space excavation, and then covered over during such final backfilling.

As has been described, the present invention also includes both an energy conservation concept and means for utilizing solar energy. With respect to energy conservation, reference is now made to FIG. 7, which shows a preformed beam 124 in cross section, constructed similarly to the beam 54 of FIG. 6, but with an important difference.

The preformed beam 124 is made of precast concrete and includes reinforcing elements 66' and 68', and an anchor plate 70' for securing it to a base plate 46. Before the beam 124 is cast from concrete C, a panel of insulating material 126 is placed therein to stand vertically for nearly the full height of the beam, and to extend longitudinally thereof for substantially its entire length. The insulation panel 126 can be made from polystyrene or a similar material, and preferably has a polyethylene vapor barrier 128 on both sides thereof. Typically, the insulation panel 126 will be about 1" thick, and it has been found that the use thereof will reduce foundation heat losses by a minimum of 10% over standard poured footing and concrete block foundation construction. As will be understood, the precast beam 124 can be designed so that the structural integrity thereof is not impaired by the presence of the insulation panel 126 therewithin.

Figure 11:
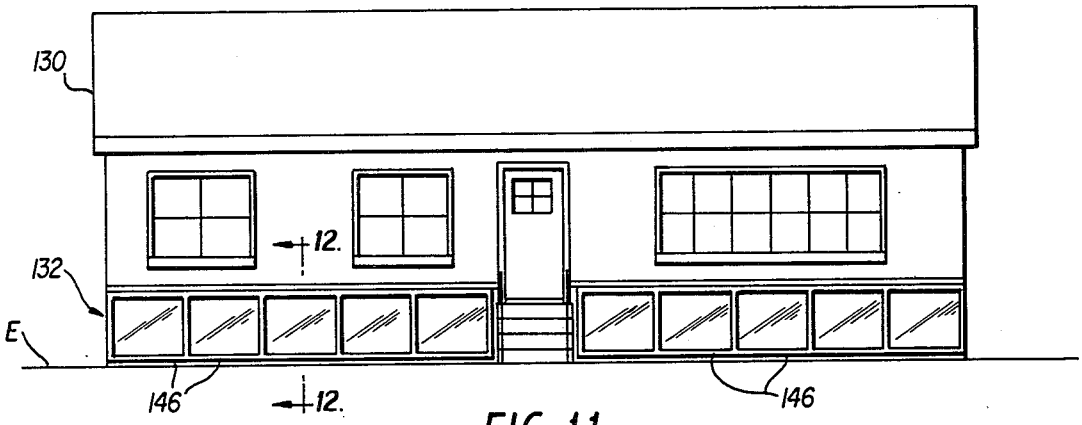
FIG. 11 is a front elevational view showing a manufactured home installed on a foundation constructed according to the present invention, the foundation incorporating the preferred embodiment of the passive solar energy equipment of the invention.
Figure 12:
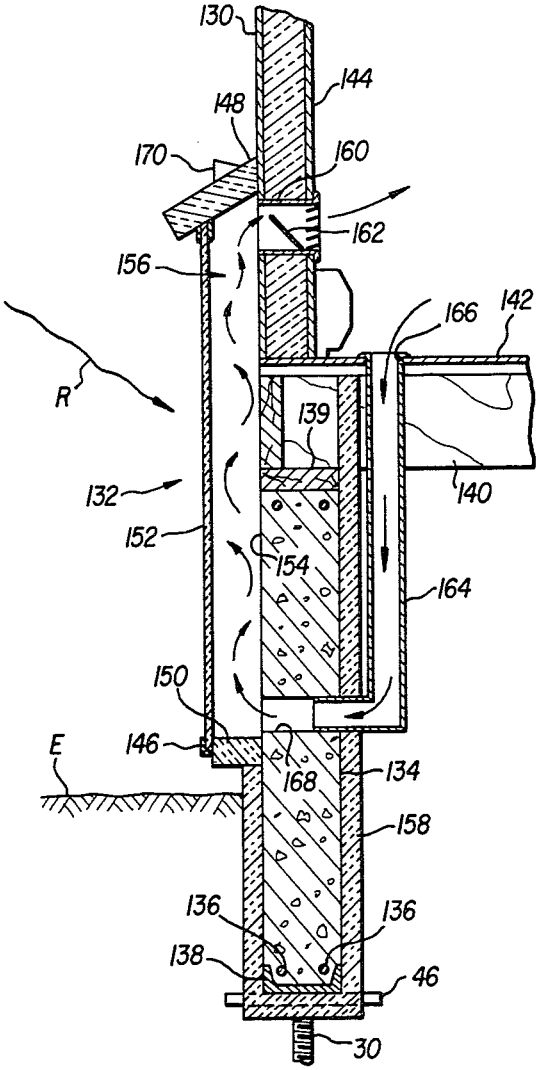
FIG. 12 is an enlarged, vertical sectional view taken generlly along the line 12—12 in FIG. 11, and shows details of the passive solar energy equipment.

The solar energy features of the invention are illustrated in FIGS. 11–16. In FIGS. 11 and 12, a dwelling building is shown generally at 130, mounted upon a foundation 132 that is constructed according to the method and system described for the foundation 2, and which incorporates a front preformed, precast beam 134 that corresponds to the beams 54,56 of FIGS. 1 and 2. The details of the foundation construction are not shown in FIGS. 11–16, since to do so would merely be repetitive of what is shown in FIGS. 1–10.

The preformed, precast concrete beam 134 is constructed similar to the beam 54 and includes reinforcement elements 136 and a metallic anchor plate 138 that is utilized to secure the beam to a base plate 46. The plate 149 carrying the floor joists 140 of the building 130 rests on the preformed beam 134, and the joists support the floor 142 and the sidewall 144 of the building. Mounted on the exterior of the outer face of the preformed beam 134 and the lower portion of the building sidewall 144 are a plurality of rectangular frames 146, each including an inclined, insulated top wall 148, and an insulated bottom wall 150 that is spaced above the grade of the earth E. The frames 146 each support a collector panel 152 of insulated glass or the like which, together with the frame containing and mounting it and the front collector face 154 of the preformed beam 134, forms a solar collector cavity 156, positioned to receive rays R from the sun.

The front collector face 154 of the preformed beam 134 within the collector cavity 156 is painted black, as is usual with solar collectors, and the collector panel 152 is spaced from the face 154 by a distance of about 4" to assure proper reflective action of the solar rays R so that a maximum amount of energy is collected from the sun. The precast concrete body of the preformed beam 134 acts as a heat sink to store the energy collected; thus, a feature of the invention is that the very preformed beams which form a part of the building's foundation are also utilized to store solar energy, eliminating the cost and engineering difficulties associated with building a seaprate heat sink or storage system. To increase the heat holding characteristics of the precast beam 134, all portions thereof outside of the collector cavity 156 are covered with insulation 158, as shown in FIG. 12.

The solar energy equipment of FIGS. 11 and 12 is of the passive type, in that it does not require circulating pumps and fans, or the like. Rather, the arrangement takes advantage of the ability of air to circulate through convection, made possible in part by placing the solar collecting equipment beneath, rather than above, the floor 142 of the building 130.

Noting again that the frames 146 project upwardly on the lower portions of the building sidewall 144, such projection is at least sufficient so that the upper end of the cavity 156 is positioned at a level above the building floor 142. The upward extension of the frames 146 can be extended further to increase the collector area, of so desired. A heating duct 160 extends through the building sidewall 144, and connects the upper end of the cavity 156 with the interior of the building. Mounted within the duct 160 is an automatic damper 162, of the known type which will open when the temperature of the air in engagement therewith exceeds a predetermined value. A return duct 164 is mounted to extend between an opening 166 cut in the building floor 142 and a return opening 168 preformed in the beam 134 and arranged to open at the bottom of the cavity 156. It is to be understood that in an actual installation there would normally be several heating ducts 160 and cold air return ducts 164.

The passive solar energy system of FIGS. 11 and 12 functions automatically to supply all or at least some of the heating needs of the building 130. As solar rays R pass through the collector panel 152 and strike the black collector face 154, heat is created within the cavity 156.

The concrete of the preformed, precast beam 134 absorbs some of this heat, and acts as a heat sink. As temperature rises within the cavity 156, the temperature of the air will exceed the setting of the automatic damper 162, say about 85° F., causing it to open. Thereafter, heated air will enter the building 130 and cold air will return to the system through the return duct 164, thereby establishing a convection air flow system.

When the temperature of the air within the cavity 156 falls below a preset value on the automatic damper 162, say about 79° F., the damper will close. Thereafter, the solar rays R will continue to build up heat within the cavity 156 until the damper again opens. Should there be a period of cloudiness, the heat sink capacity of the concrete preformed beam 134 will be effective to supply heat to the system and, indeed, the return air will begin to be heated as it flows back into the cavity 156 through the return opening 168 in the beam 134.

In some instances, the system of FIGS. 11 and 12 will supply all of the heat energy needed by the building 130 and, in others, a supplemental heating system will be required. But in either instance, the solar equipment of FIGS. 11 and 12 will provide a substantial amount of solar energy for a conventional wood or frame building, without requiring extensive modifications thereto. It has been found that the cost savings possible with the foundation method and system of the invention over a conventional poured footing and concrete block foundation are usually sufficiently great such that they will pay, or nearly pay, for the basic solar equipment associated with the passive system of FIGS. 11 and 12. Thus, the owner of the building 130 is provided with a solar energy capability at substantially no added expense and, at the same time, the remainder of the benefits from the present foundation method and system are also obtained.

When it is not desired to heat the building 130, the collector cavity 156 is merely vented directly to atmosphere through an appropriate relief vent 170, a preferably mounted on the top wall 148 of the frame 146. The top wall 148 of the frame is sloped to allow rain falling thereon to easily run off. It should be observed from FIG. 11 that the frames 146 are rather pleasing in appearance as compared to roof-mounted solar equipment, and allow the building 130 to retain a low, clean roof line. It is of course understood that the building 130 must be placed so that the frames 146 will receive proper exposure to the sum, and that the use of foundation plantings must be planned so as not to interfere with the solar energy function of the foundation.

Figure 13:
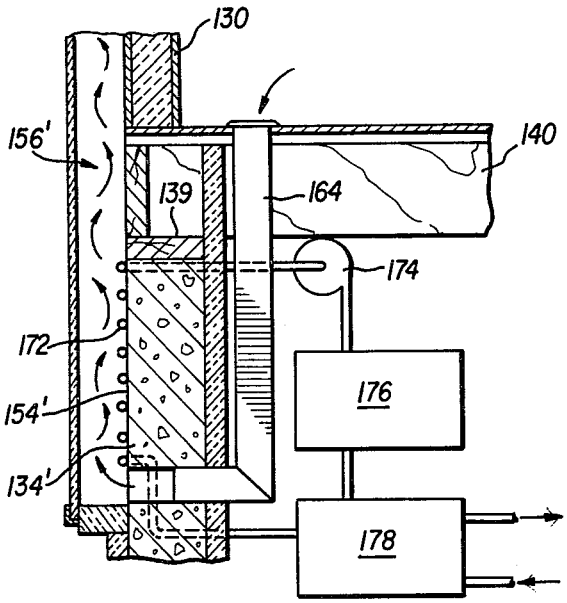
FIG. 13 is a fragmentary vertical sectional view similar to FIG. 12, but showing a modification wherein heat collector conduits are mounted on the exposed face of the preformed beam.

Referring now to FIG. 13, there is shown a modification of the solar energy system of FIGS. 11 and 12, designed to provide both active and passive solar energy collection. The system of FIG. 13 is identical in every way to that of FIG. 12 except that the collector face 154' of the preformed, precast concrete beam 134' has an array of collector conduits 172 mounted thereon, within the collector cavity 156'. The collector conduits 172 can be made from metal or plastic, and are utilized to circulate a fluid which is exposed to the heated air within the cavity 156'.

The collector conduits 172 are connected with a circulation pump 174, an expansion tank 176, and a heat exchanger 178, the pump 174 being effective to circulate the fluid through the system. The fluid can be water or one of the special fluids which have been developed for use in solar systems. The heat exchanger 178 can be connected for heating the water in a domestic hot water heater, for example, to provide heated air to the building 130 or some other area, or to perform some other energy-related purpose. While the active elements of FIG. 13 add to the cost of the solar energy system, they also increase the flexibility thereof and allow the solar energy to be used by other than a convection air system.

Figure 14:
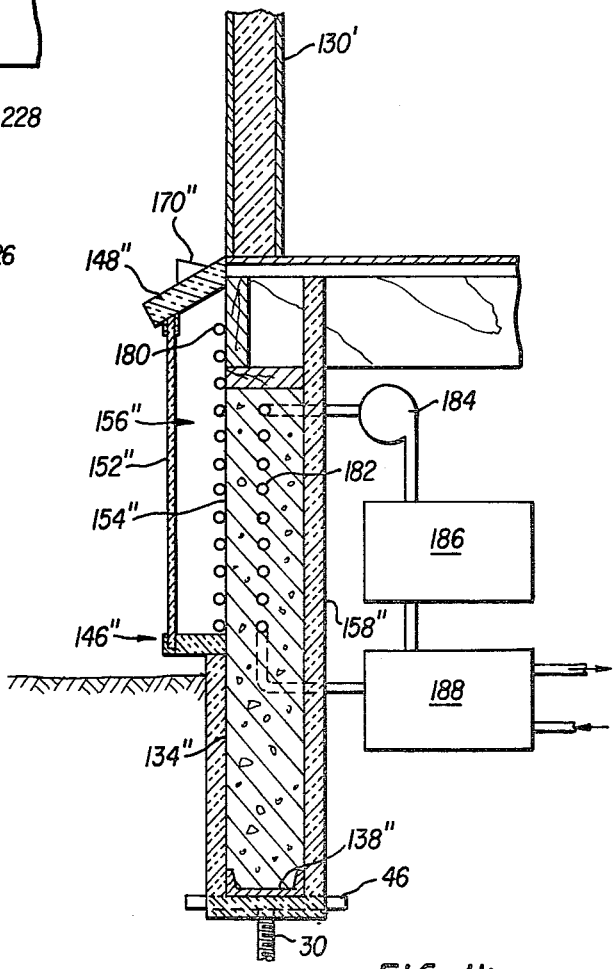
FIG. 14 is a vertical sectional view showing a different embodiment of the solar energy equipment of the invention, wherein the system is entirely active.

Turning now to FIG. 14, such shows a solar energy system in which the passive feature has been eliminated. The preformed, precast concrete beam 134" therein is constructed like the beams 134 and 134', and supports the building 130'. The frames 146" mounted on the front face of the beam 134", however, are not as tall as the frames 146, because there is no need for the heating duct arrangement to be accommodated at the upper end of the enclosed cavity 156". The frames 146" mount collector panels 152", and the black collector face 154" of the preformed beam 134" has collector conduits 180 mounted thereon as in FIG. 13.

The preformed beam 134" of FIG. 14 includes an anchor plate 138" for connecting it with a base plate 46, is covered with insulation 158", and has a plurality of collector conduits 182 embedded therewith, the conduits 180 and 182 being connected, and both thereof being connected with a circulation pump 184, an expansion tank 186 and a heat exchanger 188. The top member 148" of the frame 146" is fitted with a suitable vent duct arrangement 170" to relieve the cavity 156" when the system is not in use.

The system of FIG. 14 is quite efficient, and full use of the preformed beam 134" and its heat sink capacity is obtained. The system allows for a much higher temperature to be generated in the cavity 156" than in the cavity 154 of the system of FIG. 12, and can efficiently heat hot water or provide hot fluid to a heating system. The number and location of the collector conduits 180 and 182 can be varied; for example, the conduits can be eliminated from the surface 154" or from the interior of the concrete beam, if so desired, with some loss in collecting capacity as traded off against a less expensive system. By not using a convection system, the arrangement of FIG. 14 is compatible with buildings where such a convection system would be undesirable or not needed. For example, heat may not be required in a grain storage building, and thus the arrangement of FIG. 14 allows the energy collected to be used for some other purpose.

Figure 15:
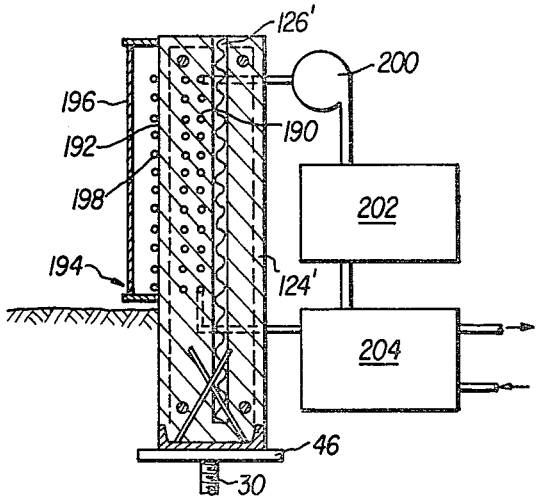
FIG. 15 is a vertical sectional view of another modification of the solar energy equipment, showing an entirely active system.
Figure 16:
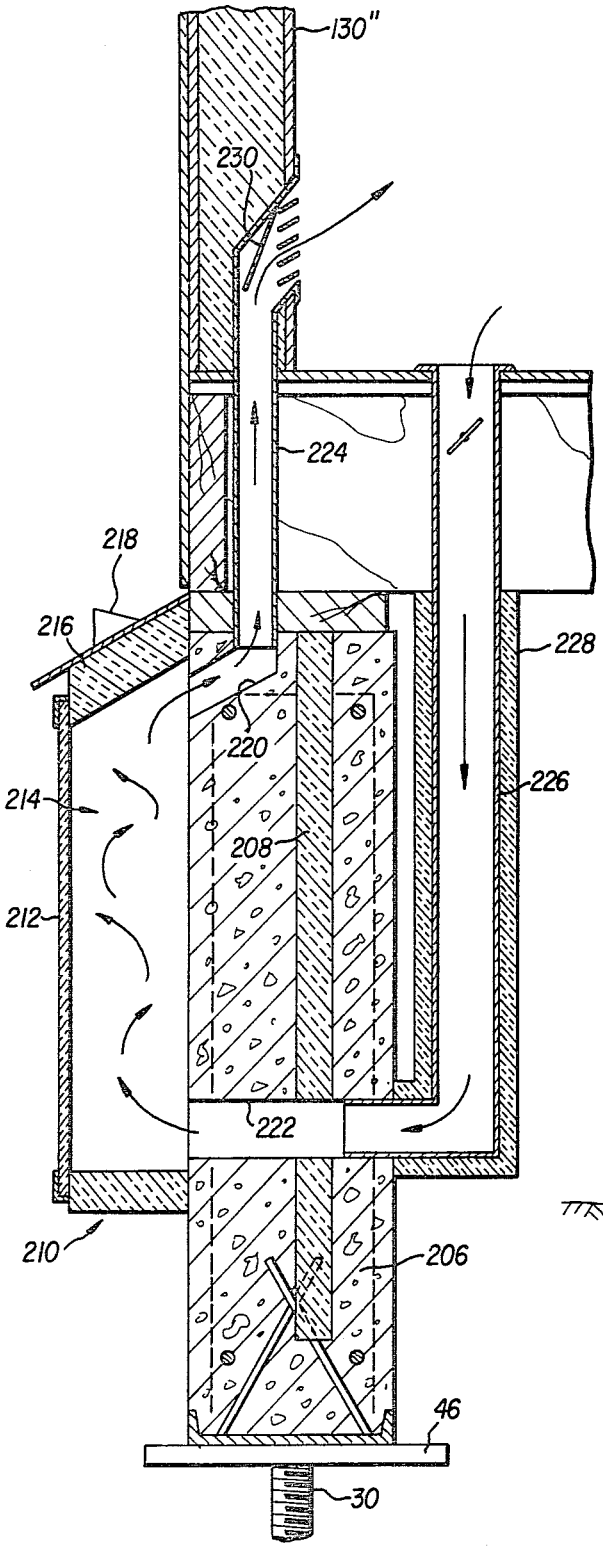
FIG. 16 is a vertical sectional view of another embodiment of the entirely passive solar energy equipment of the invention, designed to be positioned entirely beneath the building structure erected on the foundation.

Two further modifications of the solar energy equipment are shown in FIGS. 15 and 16; FIG. 15 showing a beam 124' like that shown at 124 in FIG. 7, except that it is provided with collector conduits 190 in the region between the insulation element 126' and the black collector face 192 of the beam. Mounted on the face 192 are frames 194 which mount solar panels 196, the collector face 192 also carrying collector conduits 198. The collector conduits 190 and 198 are interconnected, and are connected with a circulating pump 200, an expansion tank 202, and a heat exchanger 204.

The solar energy system of FIG. 15 is also of the exclusively active type, and is generally similar to that of FIG. 14 in operation. The external insulation element of FIG. 14 is eliminated in FIG. 15 in favor of the internal insulating element 126', with some loss in the heat storage capacity of the concrete beam 124'. But at the same time, the arrangement of FIG. 15 is less expensive than that of FIG. 14, and the external insulation is eliminated.

The solar energy system of FIG. 16 is similar to that of FIG. 12, and is of the passive type. It eliminates the through-the-wall heating duct 160 of FIG. 16, and thus is suitable for mounting entirely beneath a building 130″.

Figure 7:
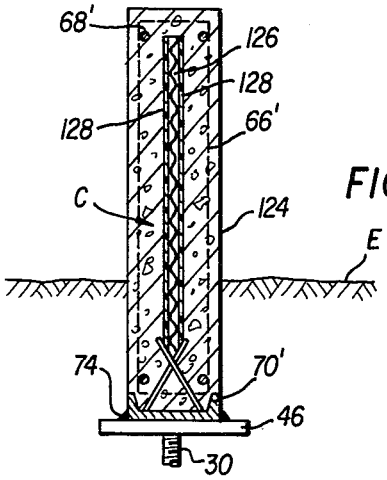
FIG. 7 is a vertical sectional view similar to FIG. 6, but showing a modified preformed beam provided with an insulation element.

The system of FIG. 16 includes a preformed, precast concrete beam 206 like the beam 124 of FIG. 7, having an insulation element 208 therewithin. Frames 210 are mounted on the front of the preformed beam 206, and mount collector panels 212 which define a collector cavity 214, the top portion 216 of the frame having a vent device 218 thereon. A heating opening 220 is cast in the upper end of the preformed beam 206 leading from the upper end of the cavity 214, and the beam also has a return opening 222 cast therein. The arrangement of FIG. 16 allows the concrete beam 206 to be mounted on its base plates 46 at the building site with the frames 210 already placed thereon, or attached at the job site. The foundation is then complete, includes the solar energy equipment, and is ready to receive the building 130″.

After the building 130″ is mounted on the foundation, the solar energy system is connected by installing a heating conduit 224 that connects with the heating opening 220, and a return conduit 226 that connects to the return opening 222, and which carries insulation 228. The system is then ready to operate as a passive solar heating system. The heating conduit 224 is provided with a thermostatically controlled damper 230 like the damper 162.

It will be appreciated that all embodiments of the solar energy equipment of the invention take full advantage of the location of the preformed beams beneath the building, and of the heat sink and the benefits resulting from utilizing precast concrete for the beams. The result, with all embodiments, is to provide an efficient solar energy system at minimum cost.

Obviously, many further modifications of the invention are possible.

I claim:

1. A method for constructing a foundation upon which a building can be erected, said method including the steps of:

excavating a plurality of spaced footing pits in the earth on the site where the building is to be erected, said pits each including a bottom and side walls;

placing a preformed footing into each of said footing pits so that the footing rests on the earthen bottom wall of its associated pit, each of said footings having a grout inlet opening extending generally vertically therethrough;

connecting a source of grout under pressure to the grout inlet opening of each of said footings, and injecting grout under pressure into the region beneath each footing until the grout fills essentially all of the space between the footing and the earthen bottom of the associated footing pit and elevation of the footing begins, so that the footing is firmly seated;

disconnecting the source of pressurized grout from each footing after it is firmly seated and before significant elevation of the footing occurs, and allowing the grout to set;

mounting a base plate means on each footing, and adjusting the top surfaces of all the base plate means after their respective footings are firmly seated, to place said surfaces in a predetermined vertical relationship to each other; and mounting horizontally extending preformed beams on the top surfaces of said base plate means, said beams extending horizontally between said base plate means and being adapted to receive and support the building to be erected on the site.

2. A method for constructing a foundation as recited in claim 1, including the further step after placing said preformed footing into its associated footing pit of:

backfilling about the perimeter of said preformed footing, so as to effectively seal off the region between the undersurface of said footing and the bottom of its associated footing pit.

3. A method for constructing a foundation as recited in claim 1, wherein the preformed footing has a recess in the undersurface thereof, and wherein said step of placing a preformed footing into its associated footing pit includes:

placing a sheet of flexible material over the undersurface of said footing to extend across said recess, whereby to define a protected cavity.

4. A method for constructing a foundation as recited in claim 3, wherein said sheet of flexible material is substantially larger in area than the area of its associated preformed footing, and wherein said step of placing said sheet of flexible material over the undersurface of said preformed footing includes the further step of pulling the edges of said sheet upwardly and inwardly against the sidewalls of its associated footing.

5. A method for constructing a foundation as recited in claim 4, including the further step after placing said preformed footing into its associated footing pit of:

backfilling about the perimeter of said preformed footing against the outside of said sheet of flexible material, so as to engage the flexible material with the sidewalls of said footing and to effectively seal off the region between the undersurfaces of said footing and the bottom of its associated footing pit.

6. A method for constructing a foundation as recited in claim 1, including the additional step before excavating said footing pits of:

excavating a crawl space area on the site where the building is to be erected, said footing pits thereafter being excavated within the area of said crawl space excavation.

7. A method for constructing a foundation as recited in claim 1 or 6, including the additional step after mounting said preformed beams of:

backfilling about said footings and the lower portions of said preformed beams, unless said preformed beams are intended to be elevated above the earth.

8. A method of constructing a foundation as recited in claim 1, wherein said footings are each provided with a plurality of spaced relief ports extending generally vertically therethrough, and wherein said step of injecting grout under pressure into the region beneath each footing continues until grout is visible at the upper ends of all of said relief ports.

9. A method for constructing a foundation as recited in claim 8, including the additional step during the step of injecting grout under pressure of:

plugging said relief ports in turn, beginning with the first relief port at which grout becomes visible.

10. A method for constructing a foundation as recited in claim 1, wherein after the step of disconnecting the source of grout from each footing occurs, the associated grout inlet opening is plugged.

11. A method of constructing a foundation as recited in claim 1, wherein each of said base plate means includes a threaded shaft having a base plate permanently fixed to the upper end thereof, and a threaded anchor permanently embedded within the top surface of the associated footing, and wherein said step of mounting a base plate means on each footing includes the steps of:

threading the lower end of said shaft into its associated threaded anchor;

turning said threaded shaft to adjust the top surface of said base plate to a preselected vertical position; and applying bending force to move said base plate relative to its associated footing, until the top surface of said base plate rests in a desired planar relationship.

12. A method for constructing a foundation as recited in claim 11, including the additional step after bending said base plate of:

filling the space between said base plate and the top surface of its associated footing with grout.

13. A method for constructing a foundation as recited in claim 1, wherein at least one of said preformed beams is provided with solar energy collector means on a side surface thereof, and wherein said step of mounting said preformed beams includes placing said beam carrying said solar energy collector means so that said solar energy collector means is arranged for exposure to the sun.

14. A method for constructing a foundation as recited in claim 1, wherein said base plate means is made of metal and said preformed beams have metal anchor plates therein in the regions where they contact said base plate means, and wherein said step of mounting said preformed beams includes the step of welding said anchor plates to said base plate means.

15. A foundation system upon which a building can be erected, the site where the building is to be erected being prepared by excavating in the earth a plurality of spaced footing pits each having a bottom and side walls, and said foundation system including:

a plurality of preformed footings, one for each of said footing pits, each of said preformed footings having a recessed bottom surface and a grout inlet opening extending generally vertically therethrough;

anchor means permanently embedded centrally in the top surface of each of said footings;

said footings each being adapted to have grout under pressure injected therebeneath through said grout inlet opening after the footing has been placed in its associated footing pit to rest on the earthen bottom thereof, the injection of the grout continuing until essentially all of the space between the footing and the bottom of its associated footing pit is filled and the footing is firmly seated;

shaft means mounted in each of said anchor means, and projecting upwardly from the top surface of its associated footing;

a base plate permanently fixed on the upper end of each of said shaft means, said shaft means all being vertically adjustable relative to said anchoe means to fix the upper surfaces of their respective base plates at a preselected vertical position; and a plurality of preferred horizontally extending beams arranged to be mounted on and extending between said base plates, and forming a supporting base for the building to be erected on the site.

16. A foundation system as recited in claim 15, wherein each of said preformed footings also includes a plurality of spaced relief ports extending generally vertically therethrough, the lower ends of said relief ports opening into the recessed bottom surface of the footing, and said relief ports being spaced from said grout inlet opening.

17. A foundation system as recited in claim 16, wherein each of said preformed footings further includes:

a sheet of flexible material receivable over the bottom surface of said preformed footing, and adapted to form with said recess a protected cavity for receiving grout.

18. A foundation system as recited in claim 16, wherein each of said preformed footings further includes:

plug means for closing said grout inlet opening, to prevent the leakage of grout from the region beneath the footing.

19. A foundation system as recited in claim 15, wherein said anchor means and said shaft means are threaded, each of said shaft means being receivable within its associated anchor means and being vertically adjustable by turning it relative thereto.

20. A foundation system as recited in claim 19, wherein said base plate is secured centrally of its bottom surface to the upper end of its associated shaft means, and is bendable relative to said shaft means about the central axis thereof for adjusting the top surface of said base plate to substantially any desired planar orientation.

21. A foundation system as recited in claim 15, wherein said preformed beams are made of precast concrete.

22. A foundation system as recited in claim 21, wherein said preformed, precast concrete beams have metal anchor plates embedded therein and wherein said base plates are made of metal, whereby said beams can be secured to each other and to said base plates by welding said anchor plates and said base plates to each other.

23. A foundation system as recited in claim 21, wherein said preformed, precast concrete beams each has a vertically disposed, longitudinally extending insulation element embedded therein, for reducing lateral heat transmission therethrough.

24. A foundation system as recited in claim 21, wherein at least one of said preformed, precast concrete beams carries a solar energy collector means, and wherein said foundation system further includes means for connecting said solar energy collector means with a building to be erected upon the supporting base formed by said plurality of preformed beams.

25. A foundation system as recited in claim 24, wherein said solar collector means includes collector conduits secured to the exposed face of said preformed, precast beam, and means for circulating fluid through said conduits.

26. A foundation system as recited in claim 24, wherein said solar energy collector means includes collector conduits cast into said preformed, precast beam, and means for circulating fluid through said conduits.

27. A foundation system as recited in claim 24, wherein said solar energy collector means includes collector conduits cast into said preformed, precast beam and also secured to the collector face of said beam, and means for circulating fluid through said conduits.

28. A foundation system as recited in any one of claims 24, 25 or 26, wherein said solar energy collector means further includes passageway means arranged to establish a convection air flow between said solar energy collector means and the interior of a building placed on said supporting base.

29. A foundation system as recited in claim 24, wherein said solar energy collector means includes a collector cavity, and passageway means arranged to establish a convection air flow between said cavity and the interior of a building placed on said supporting base, said passageway means including a heating duct connected with the upper end of said collector cavity, and a cold air return duct connected with the lower end of said collector cavity.

30. In combination, a foundation system and a building erected upon said foundation system, said foundation system including:

a plurality of horizontally extending preformed beams connected to each other, each beam having top and bottom surfaces, and at least one of said beams being made of precast concrete and forming a heat sink; and means engaged with the bottom surfaces of said preformed beams for supporting said horizontally extending preformed beams upon the earth, whereby the top surfaces of said beams form a foundation upon which a building can be erected;

a building mounted on the foundation formed by the top surfaces of said preformed beams, and including a floor and vertical sidewalls; and solar energy collecting means associated with said preformed beams and adapted to utilize the heat sink formed by said precast concrete beam(s), arranged to supply solar-generated heat to said building, said solar energy collecting means being operatively independent of the floor and sidewalls of said building and including:

solar energy collector means connected with said precast concrete beam, and including:

frame means connected to the front face of said precast concrete beam and extending horizontally thereof, and including a rear face; and collector panel means carried by said frame means, and spaced from said frame means rear face to define a collector cavity for generating solar heat, said collector cavity being arranged relative to said precast concrete beam so that at least a part of the solar heat generated therewithin impinges upon said precast concrete beam and is absorbed by the heat sink formed thereby; and means for collecting solar heat energy from within said collector cavity and from said heat sink, and connected with said building to distribute said heat to said building.

31. In the combination as recited in claim 30, wherein said means for collecting solar energy includes:

collector conduit means on at least one of said rear face of said collector cavity and within said precast beam; and means for circulating fluid through said collector conduit means, said fluid being effective to collect heat generated by said solar energy collector means and distribute it to a location for use.

32. In the combination as recited in claim 31, wherein collector conduit means is located both on said rear face of said collector cavity, and within said precast beam.

33. In the combination as recited in claim 30, wherein said means for collecting solar energy includes:

passageway means arranged to establish a convection air flow between said collector cavity and the interior of said building, said passageway means including a heating duct connected with the upper end of said collector cavity, and a cold air return duct connected with the lower end of said collector cavity.

34. In the combination as recited in claim 30, wherein said means for collecting solar energy includes ducts at least partially cast into said precast beam.

35. In the combination as recited in claim 33, wherein said means for collecting solar energy further includes:

collector conduit means on at least one of said rear face of said collector cavity and within said precast beam; and means for circulating fluid through said collector conduit means, said fluid being effective to collect heat generated by said solar energy collector means and distribute it to a location for use.

36. In the combination as recited in any one of claims 30, 31, 33, 34 or 35, including additionally insulation means carried by said precast concrete beam on substantially the entire outer surface thereof except for the portion of said front face where said frame means is connected, to improve the heat sink characteristics of said beam.

37. In a foundation system upon which a building can be erected, said foundation system including a plurality of preformed beams for supporting said building, a plurality of footing means for supporting said preformed beams, each of said footing means comprising:

a preformed footing adapted to be placed in a footing pit dug in the earth, said footing having a recess in its bottom surface, and a grout inlet opening extending generally vertically therethrough from the top surface of the footing to said recess;

a sheet of flexible material extending across said recess to define a cavity for receiving grout injected into said recess through said grout inlet opening; and base plate means mounted on said preformed footing and adapted to receive one of said preformed beams.

38. In a foundation system as recited in claim 37, wherein said base plate means comprises:

an internally threaded anchor means permanently embedded in the top surface of said preformed footing;

a threaded shaft, the lower end of said shaft being receivable within said permanently embedded anchor means; and a base plate permanently fixed to the upper end of said shaft.

39. In a foundation system as recited in claim 38, wherein said base plate is secured centrally of the bottom surface thereof to the upper end of said shaft.

40. In a foundation system as recited in claim 39, including additionally:

a column mounted on the top surface of said base plate and extending upwardly therefrom; and a mounting plate carried by the upper end of said column and adapted to support the joists of a building erected upon said foundation system, said mounting plate having openings therethrough for receiving fasteners for securing said joists thereto.

41. In a foundation system as recited in claim 37, including additionally:

a flap valve secured to the bottom wall of said recess and arranged to extend over the lower end of said grout inlet opening, whereby after said recess has been filled with grout under pressure said flap valve will prevent outflow of said grout through said inlet opening.

42. In a foundation system as recited in claim 41, wherein said grout inlet opening extends through said footing at an angle to the vertical, with the bottom of said opening located centrally of the bottom wall of said recess.

43. In a foundation system as recited in claim 37, including additionally:

a plurality of relief ports extending generally vertically through said preformed footing, all of said relief ports opening into said recess, and said ports being spaced from each other and located generally along the periphery of said recess.

* * * * *